US009750287B2

(12) United States Patent
Cohen Larren et al.

(10) Patent No.: US 9,750,287 B2
(45) Date of Patent: Sep. 5, 2017

(54) BODY SHAPER HAVING CROTCH OPENING

(71) Applicant: Peesies LLC, New York, NY (US)

(72) Inventors: Katherine Cohen Larren, New York, NY (US); Damian Dominguez, Brooklyn, NY (US); Dinna Soliman, Brooklyn, NY (US)

(73) Assignee: Peesies, LLC, New York, NY (US)

( * ) Notice: Subject to any disclaimer, the term of this patent is extended or adjusted under 35 U.S.C. 154(b) by 227 days.

(21) Appl. No.: 14/203,003

(22) Filed: Mar. 10, 2014

(65) Prior Publication Data

US 2014/0273735 A1 Sep. 18, 2014

Related U.S. Application Data

(60) Provisional application No. 61/780,960, filed on Mar. 13, 2013.

(51) Int. Cl.
*A41C 1/00* (2006.01)
*A41B 9/00* (2006.01)

(52) U.S. Cl.
CPC ..... *A41C 1/00* (2013.01); *A41B 9/005* (2013.01)

(58) Field of Classification Search
CPC ..... A41C 1/00; A41C 9/005
(Continued)

(56) References Cited

U.S. PATENT DOCUMENTS 1,414,986 A * 5/1922 Lippman ..... A41B 9/08 2/78.2
1,659,406 A * 2/1928 McCabe ..... A61F 5/03 450/103
(Continued)

FOREIGN PATENT DOCUMENTS

FR 848372 A * 10/1939 ..... A41C 1/00
JP 2008050718 A 3/2008
(Continued)

OTHER PUBLICATIONS

International Search Report and Written Opinion, corresponding International Application No. PCT/US2014/022360, mailed Aug. 14, 2014.

*Primary Examiner* — Gloria Hale
(74) *Attorney, Agent, or Firm* — Marshall, Gerstein & Borun LLP

(57) ABSTRACT

A body shaper can include a torso portion, first and second leg portions extending from the torso portion, a crotch portion disposed at an end of the torso portion between the first and second leg portions. The crotch portion comprises an opening, a first crotch portion extension and a second crotch portion extension, the first and second crotch portions being movable between a first configuration, in which the first and second crotch portion extensions are joined to cover the opening and a second configuration in which the first and second crotch portion extensions are separated to expose the opening. The body shaper further includes a first gap disposed between the first leg portion and the first crotch side and a second gap disposed between the second leg portion and the second crotch side, the second gap having a length extending from the first crotch end to the second crotch end and a width extending from the second crotch side to the second leg portion.

26 Claims, 8 Drawing Sheets

(58) Field of Classification Search
USPC ..... 2/108, 405, 234, 78.2, 408; 450/103, 450/104, 105, 22, 94, 95, 96, 100, 102, 450/149, 148
See application file for complete search history.

(56) References Cited

U.S. PATENT DOCUMENTS

| | | | | | |
|---|---|---|---|---|---|
| 2,323,451 | A * | 7/1943 | Bullinger | A41B 9/04 | 128/891 |
| 2,437,830 | A | 3/1948 | McAllister | | |
| 2,450,631 | A | 10/1948 | Buchler | | |
| 2,548,660 | A | 4/1951 | Feldman | | |
| 2,875,763 | A | 3/1959 | Marchisella | | |
| 3,022,788 | A | 2/1962 | Darcey | | |
| 3,040,751 | A | 6/1962 | Mastenbrook | | |
| 3,171,413 | A | 3/1965 | Jones | | |
| 3,224,448 | A | 12/1965 | Diebold | | |
| 3,533,412 | A * | 10/1970 | Bayer | A41C 1/02 | 450/104 |
| 3,590,823 | A | 7/1971 | Pope, Jr. | | |
| 3,913,146 | A | 10/1975 | Zero | | |
| 3,974,836 | A | 8/1976 | Carlson | | |
| 4,301,550 | A | 11/1981 | Carver | | |
| 4,597,110 | A | 7/1986 | Smith, Sr. et al. | | |
| 5,014,364 | A | 5/1991 | Orr | | |
| 5,717,998 | A | 2/1998 | Everett et al. | | |
| 5,790,984 | A | 8/1998 | Doubleday | | |
| 5,930,838 | A | 8/1999 | Carter-Scott-Pomije | | |
| 6,074,274 | A * | 6/2000 | Pyatt | A41C 1/003 | 2/228 |
| 6,298,486 | B1 | 10/2001 | Huang | | |
| 6,324,699 | B1 | 12/2001 | Cosmah | | |
| 6,704,942 | B2 | 3/2004 | Lazarian | | |
| 6,964,065 | B2 | 11/2005 | Stevenson | | |
| 7,100,214 | B1 | 9/2006 | Murray | | |
| 7,553,303 | B2 | 6/2009 | Speak | | |
| 8,230,520 | B2 | 7/2012 | Riondato | | |
| 2006/0277649 | A1 * | 12/2006 | Smith | A41B 11/006 | 2/69 |
| 2006/0277663 | A1 | 12/2006 | King | | |
| 2008/0216204 | A1 | 9/2008 | Poling | | |
| 2008/0222770 | A1 | 9/2008 | Oates | | |
| 2009/0118574 | A1 | 5/2009 | Stephenson | | |
| 2010/0269243 | A1 | 10/2010 | Paree | | |
| 2011/0016604 | A1 | 1/2011 | Lim | | |
| 2011/0030129 | A1 | 2/2011 | Heffner | | |
| 2012/0060264 | A1 | 3/2012 | Wilkins | | |
| 2014/0182048 | A1 * | 7/2014 | Gregory | A41B 9/005 | 2/400 |

FOREIGN PATENT DOCUMENTS

| | | | |
|---|---|---|---|
| JP | 2008214809 | A | 9/2008 |
| RU | 2172 | U1 | 6/1996 |
| RU | 53539 | U1 | 5/2006 |

* cited by examiner

BODY SHAPER HAVING CROTCH OPENING

CROSS-REFERENCE TO RELATED APPLICATIONS

The benefit under 35 U.S.C. §119(e) of U.S. Provisional Patent Application No. 61/780,960 filed Mar. 13, 2013, is hereby claimed, and the disclosure is incorporated herein by reference in its entirety.

BACKGROUND

Field of the Disclosure

The disclosure is directed to a body shaper having a reclosable opening that exposes a crotch region of a wearer.

BRIEF DESCRIPTION OF RELATED TECHNOLOGY

Body shapers and body shaping garments provide a means by which a wearer can improve their shape and appearance. Body shapers can improve the wearer's appearance by giving the wearer a smoother more slim appearance. Typically, body shapers are made out of tight fitting, stretchable fabrics that provide compression to regions of the body in order to enhance the appearance of smoothness and slimness of the wearer.

Body shapers come in a variety of sizes and can be designed to provide shaping to the torso, butt, and/or thighs.

As a result of the need for the shapers to be tighter fitting to provide compression and the shaping function, it can be difficult to remove the shaper should the wearer need to use the restroom. While some shaper or pantyhose type garments have been provided with small openings that can allow for urination, such openings are often difficult to maneuver, do not remain closed, and/or require the wearer's hands to remain in the crotch region to hold the region open, and can be very small, which can result in accidental soiling of the wearer's hands and/or the garment.

SUMMARY

There remains a need for a body shaper having an opening feature that allows the wearer to both urinate and defecate without removal of the shaper and with the wearer's hands and the garment remaining safely distanced to avoid accidental soiling.

In accordance with an embodiment, a body shaper can include a torso portion, first and second leg portions extending from the torso portion, a crotch portion disposed at an end of the torso portion between the first and second leg portions. The crotch portion comprises an opening, a first crotch portion extension and a second crotch portion extension, the first and second crotch portions being movable between a first configuration, in which the first and second crotch portion extensions are joined to cover the opening and a second configuration in which the first and second crotch portion extensions are separated to expose the opening. When the first and second crotch portion extensions occupy the first configuration, the crotch portion has a first crotch end adjacent the torso portion a second crotch end disposed opposite the first crotch end away from the torso portion, a first crotch side disposed proximate to and spaced from the first leg portion, and a second crotch side disposed opposite the first crotch side and spaced from the second leg portion. The body shaper further includes a first gap disposed between the first leg portion and the first crotch side, the first gap having a length extending from the first crotch end to the second crotch end and a width extending from the first crotch side to the first leg portion; and a second gap disposed between the second leg portion and the second crotch side, the second gap having a length extending from the first crotch end to the second crotch end and a width extending from the second crotch side to the second leg portion.

In accordance with another embodiment, a method of making a body shaper, comprising cutting first and second gaps into a tubular knit, wherein the tubular knit comprises first and second leg portions extending from a torso portion, wherein the first and second gaps define a crotch portion separated from the first and second leg portions, respectively. The method further includes cutting the crotch portion to define a first crotch portion extension and a second crotch portion extension, the first and second crotch portion extensions being movable from a first configuration in which the first and second crotch portion extensions are joined, and a second configuration in which the first and second crotch portion extensions are separated to expose a crotch of the wearer.

DETAILED DESCRIPTION

A body shaper in accordance with embodiments of the disclosure includes a separable crotch portion that open to expose at least the crotch region of the wearer. The body shaper advantageously allows the wearer to use the restroom without the need to remove the body shaper. This is advantageous because body shapers are designed to be tight fitting articles that difficult to remove and can be particular difficult to remove when wearing certain garments. Body shapers in accordance with embodiments of the disclosure advantageously allow the wearer not only the ability to urinate, but also defecate, if needed. The crotch portions separate to expose the entire crotch and anal region of the wearer and can be pulled away from these regions such that the wear's hands remain a comfortable distance when urinating or defecating.

Figures 1A, 1B:
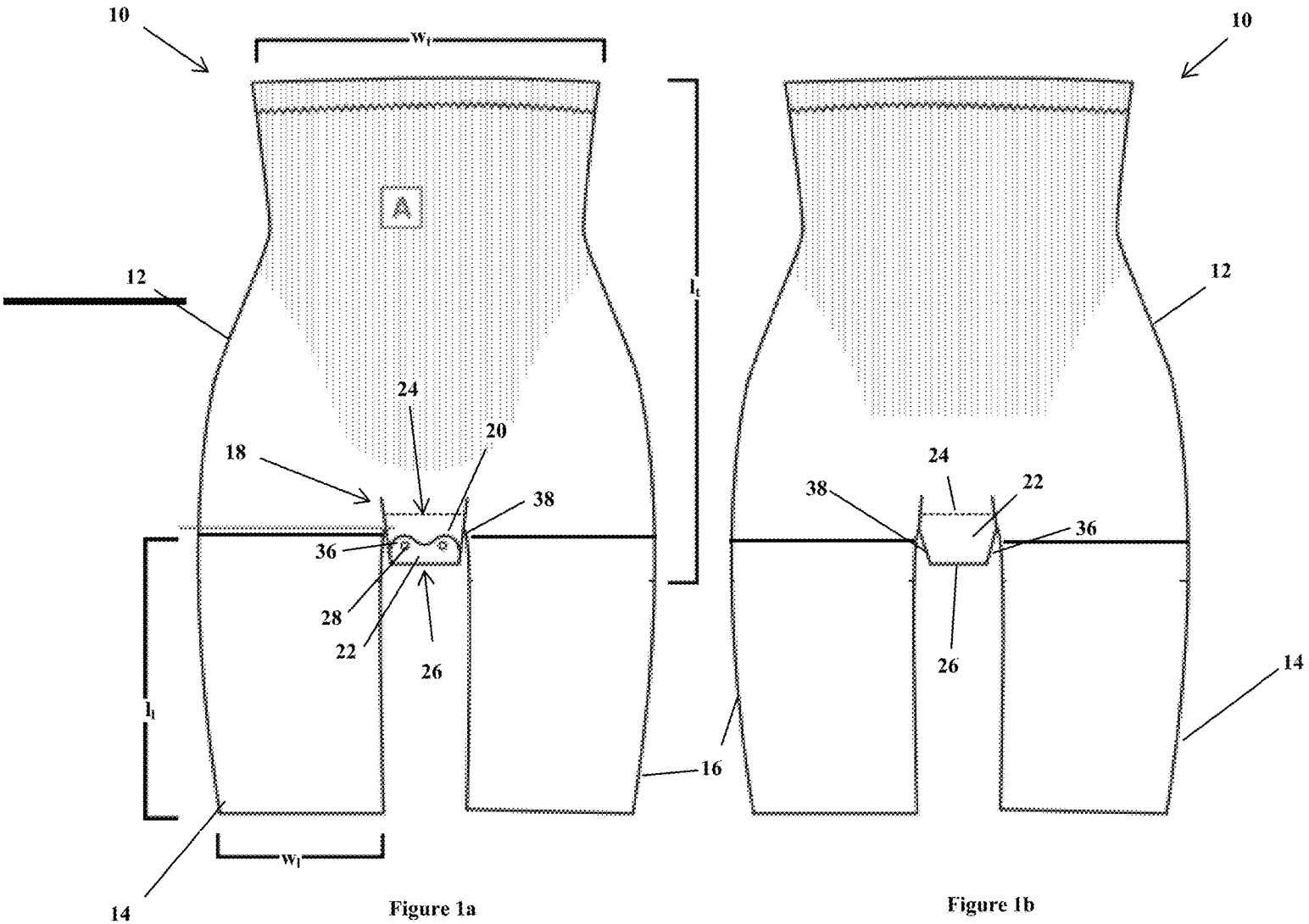
FIG. 1*a* is a front view of a body shaper in accordance with an embodiment of the disclosure.
FIG. 1*b* is a back view of the body shaper of FIG. 1*a;*

Referring to FIG. 1*a*, in accordance with an embodiment of the disclosure, the body shaper 10 includes a torso portion 12 with first and second leg portions 14, 16 extending from the torso portion 12. A crotch portion 18 is disposed at the end of the torso portion 12 between the first and second leg portions 14, 16. The crotch portion 18 includes a first crotch end 24 attached to the torso portion 12, and a second crotch end 26 opposite the first crotch end. The crotch portion 18 also includes first and second crotch sides 36, 38 spaced from the first and second leg portions 14, 16, respectively.

The body shaper further includes first and second gaps 32, 34 disposed between the crotch portion 18 and the first and second leg portions 14, 16. Beneficially the gaps are arranged and sized such that they do not interfere or diminish the shaping function of the body shaper. Conventionally, body shapers utilize tension through the hip and leg regions to provide the shaping function. Cuts being positioned into such conventional body shapers would be expected to degrade or even prevent the shaper from properly functioning as a shaper. The body shaper in accordance with embodiments of the disclosure, however, advantageously retains the body shaping function, while allowing the crotch portion to be separated from the leg portions to allow for enhanced movability and comfort to the wearer. Furthermore, the gaps can aid in the functionality of the crotch portion and can allow for an enhanced ability to separate the crotch portion extensions 20, 22 to expose not only the crotch region but also the anal region, as well as allow the wearer to pull the first and second portions of the crotch portion sufficiently away from the crotch region to avoid accidentally soiling their hands while holding the crotch portion in the second (open) position.

Body shapers are generally formed of stretch fabrics capable of providing compression against the body. For example, the body shaper can be formed of a tubular knit. The body shaper can include fabric ribs on portions of the shaper, for example, on all or part of the torso portion 12 and/or the leg portions. The ribs can provide improved fit or can be decorative. Other features can be included, such as rubber stitching or strips to facilitate holding the shaper in place against the body of the wearer. In various embodiments, the body shaper can be formed from a single piece of fabric, with the gaps 32, 34 being cut into the fabric. Seams can be formed along edges of the shaper, including edges of the gaps to provide a more finished look. This can also provide improved comfort when the edges engage the wearer's skin.

Figure 2A:
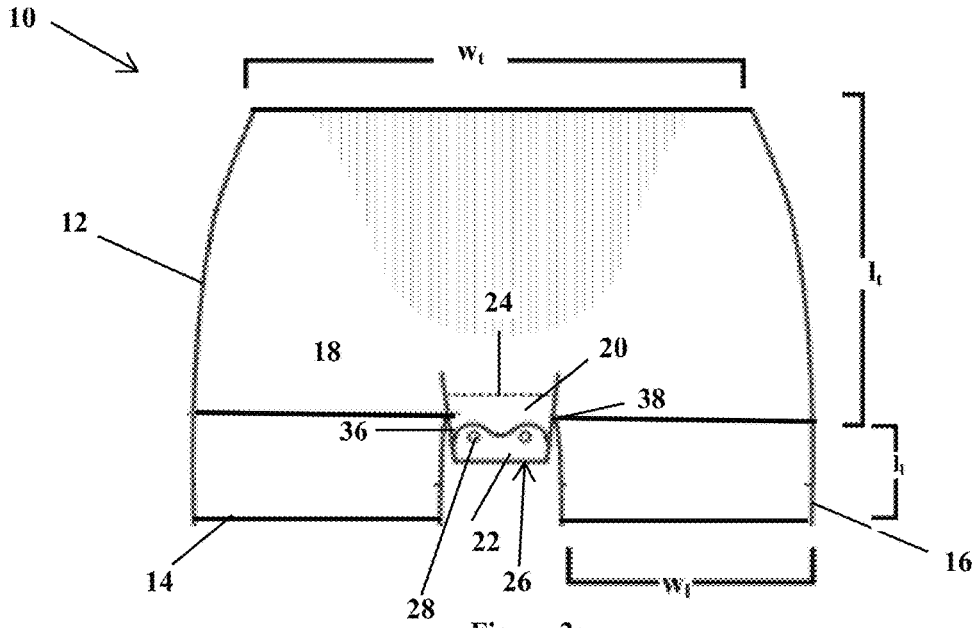
FIGS. 2*a*-2*c* are front views of body shapers in accordance with embodiments of the disclosure having different torso and leg portion lengths.
Figure 2B:
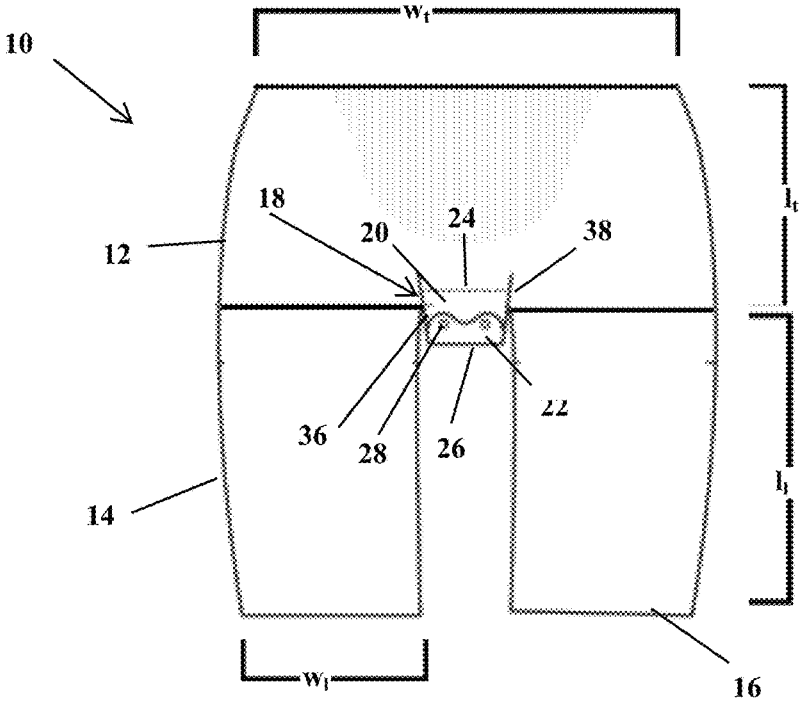
Figure 2C:
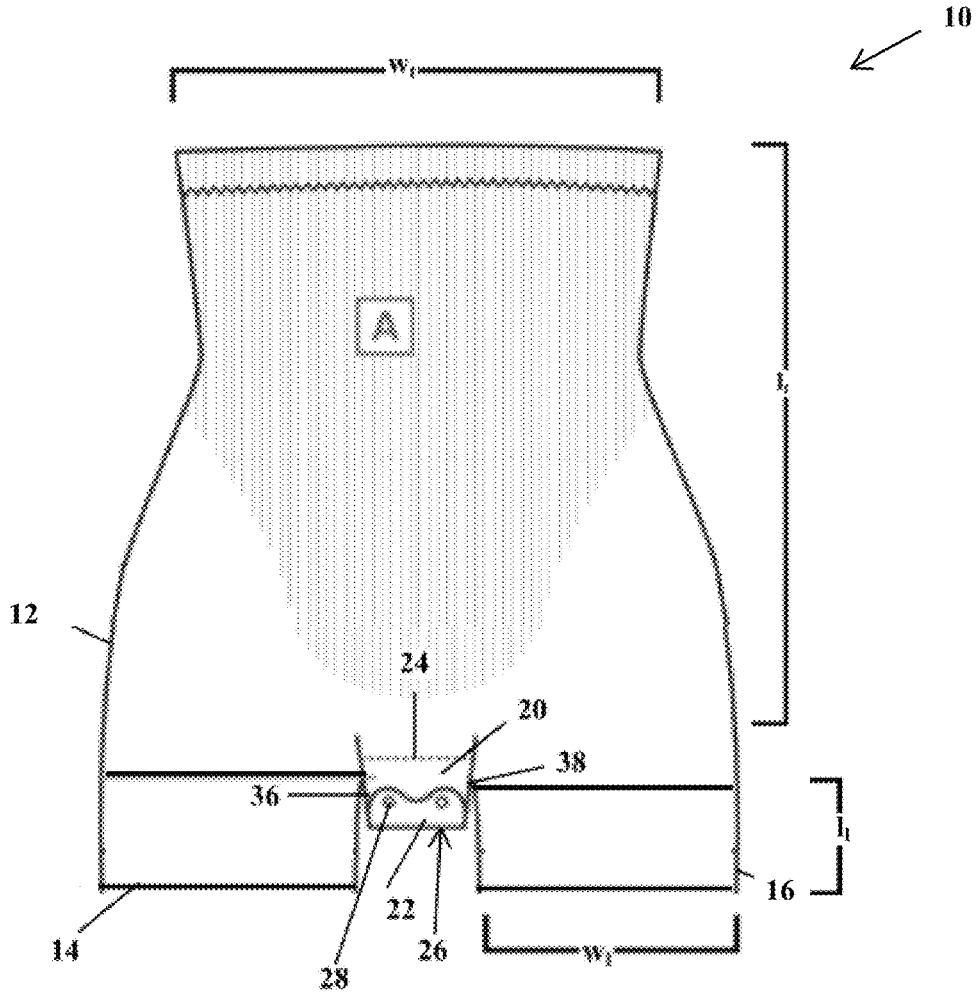

Referring to FIGS. 1-2*c*, the body shaper 10 can have any size depending on the size of the wearer and the desired shaping function. For example, the body shaper 10 can extend to a variety of positions on the wear's torso depending on the desired shaping function. For example, the torso portion 12 of the body shaper can extend up to the wear's chest (as shown in FIGS. 1 and 2*c*), can extend to the user's waist or just above the user's waist (as shown in FIG. 2*a*), or can reside at the user's hips, like a pair of woman's underwear (as shown in FIG. 2*b*). In an embodiment, the body shaper can include a bra region that extends over the user's chest.

In an embodiment, the torso portion 12 can have a length $l_t$, extending from the leg portions 14, 16 to the tip of the torso portion of about 3 inches to about 30 inches, about 5 inches to about 25 inches, about 8 inches to about 20 inches, about 10 inches to about 15 inches, about 8 inches to about 20 inches, about 3 inches to about 10 inches. Other suitable lengths include, for example about 3, 4, 5, 6, 7, 8, 9, 10, 12, 14, 16, 18, 20, 22, 24, 26, 28, 30, 32, 34, 36, 38, 40, 42, 44, 46, and 48 inches. Other lengths may be suitable depending on the size of the wearer and the intended length to which the torso portion 12 is desired to extend when worn (e.g., to or above the wearer's waist, to the wearer's hips, up to the wearer's chest).

The torso portion can have a width $w_t$ depending on the size of the wearer and such that the torso portion is tight fitting to provide a shaping function. For example, the torso portion can have a width of about 5 inches to about 48 inches, about 10 inches to about 20 inches, about 30 inches to about 48 inches, or about 8 inches to about 15 inches. Other suitable widths include, for example, about 5, 6, 7, 8, 9, 10, 11, 12, 13, 14, 16, 18, 20, 22, 24, 26, 28, 30, 32, 34, 36, 38, 40, 42, 44, 46, and 48 inches.

Referring to FIGS. 1-2*c*, the first and second leg portions 14, 16 can extend from the torso portion to any desired length depending on the desired shaping function. For example, the first and second leg portions 14, 16 can extend to the wearer's mid- to lower-thigh region (as shown in FIGS. 1 and 2*a*) to provide full leg shaping functionality. In other embodiments, the first and second leg portions 14, 16 can extend only partially down the leg to the upper thigh region (as shown in FIGS. 2*b* and 2*c*).

For example, the first and second leg portions 14, 16 can have a length $l_l$ of about 3 inches to about 20 inches, about 4 inches to about 6 inches, about 3 inches to about 5 inches, about 4 inches to about 18 inches, about 6 inches to about 16 inches, about 8 inches to about 16 inches, about 10 inches to about 14 inches, about 6 inches to about 10 inches and about 10 inches to about 20 inches. Other suitable lengths include, about 3, 4, 5, 6, 7, 8, 9, 10, 11, 12, 13, 14, 15, 16, 17, 18, 19, and 20 inches. Other length portion lengths may be suitable depending on the intended size of the wearer and the desired length to which the leg portions are intended to extend on the wearer (e.g, upper thigh, lower thigh, mid thigh).

The first and second leg portions 14, 16 can have any suitable width $w_l$ depending on the size of the wearer. For example, the leg portions 14, 16 can have a width of about 3 inches to about 15 inches, about 4 inches to about 5 inches, about 5 inches to about 8 inches, about 10 inches to about 15 inches, about 4 inches to about 10 inches. Other suitable widths include, for example, about 3, 4, 5, 6, 7, 8, 9, 10, 11, 12, 13, 14, and 15 inches. In one embodiment, the width of the leg portions is 5¾ inches.

In various embodiments, the body shaper extends to cover the buttocks of the wearer and can provide a shaping function to the buttock region regardless of the length of the first and second leg portions.

Figure 3:
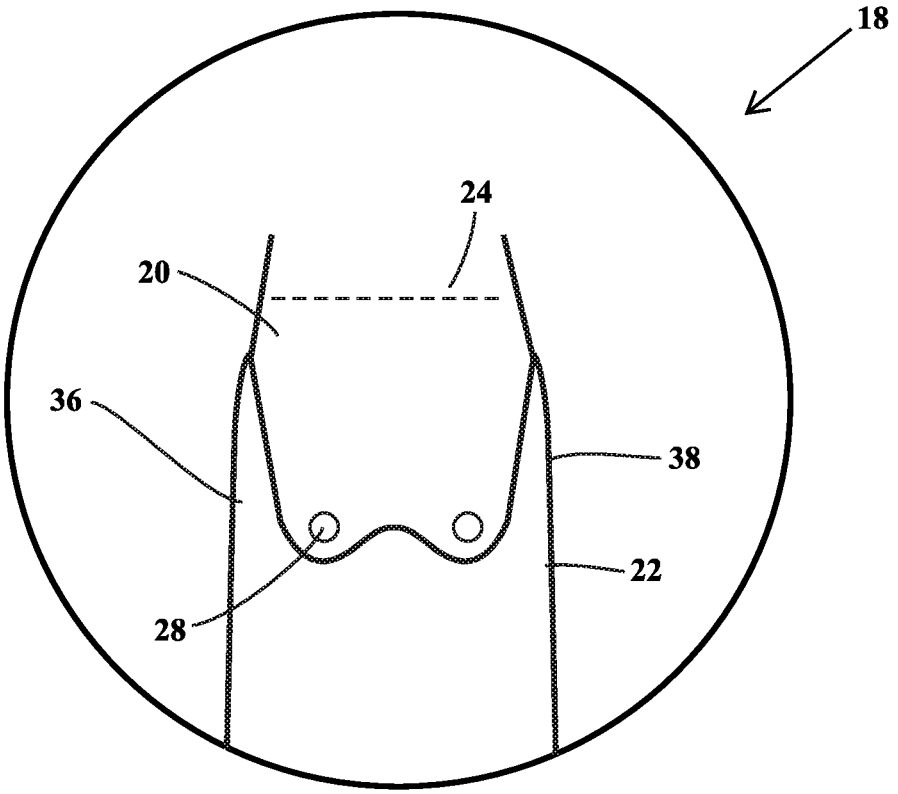
FIG. 3 is schematic of the crotch portion in the closed position of a body shaper in accordance with an embodiment of the disclosure.
Figure 6A:
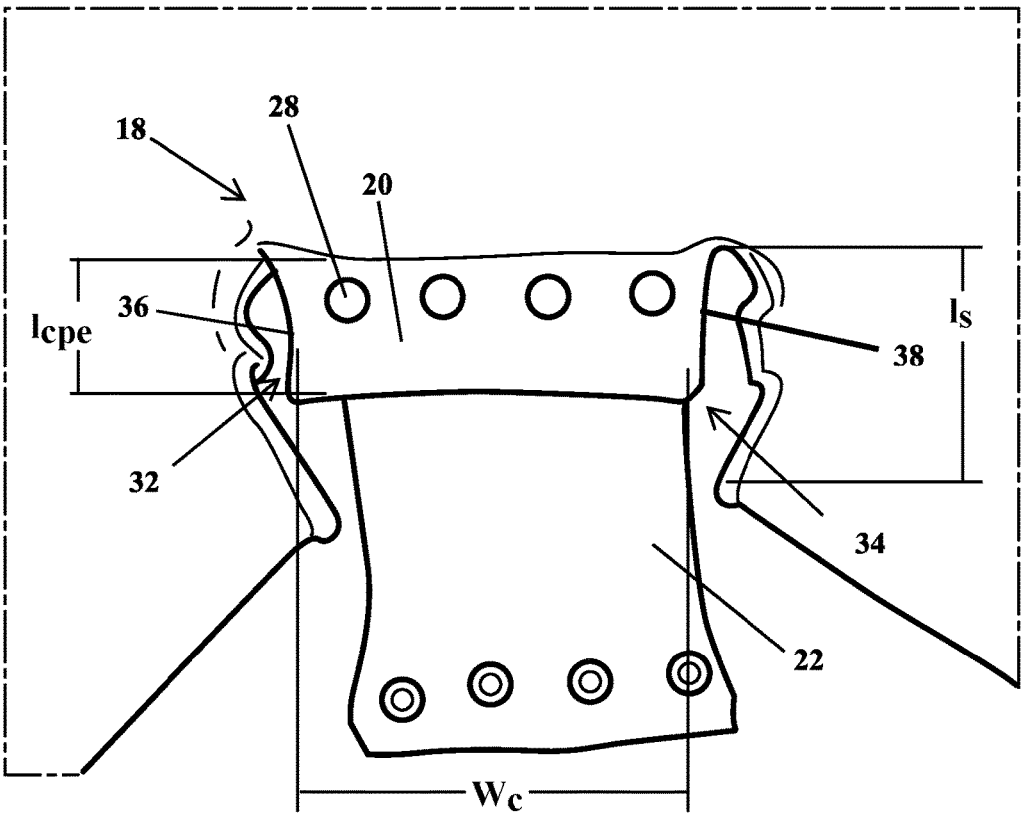
FIG. 6*a* is front view of the crotch portion of a body shaper in accordance with an embodiment of the disclosure with the crotch portion in the open position.
Figure 6B:
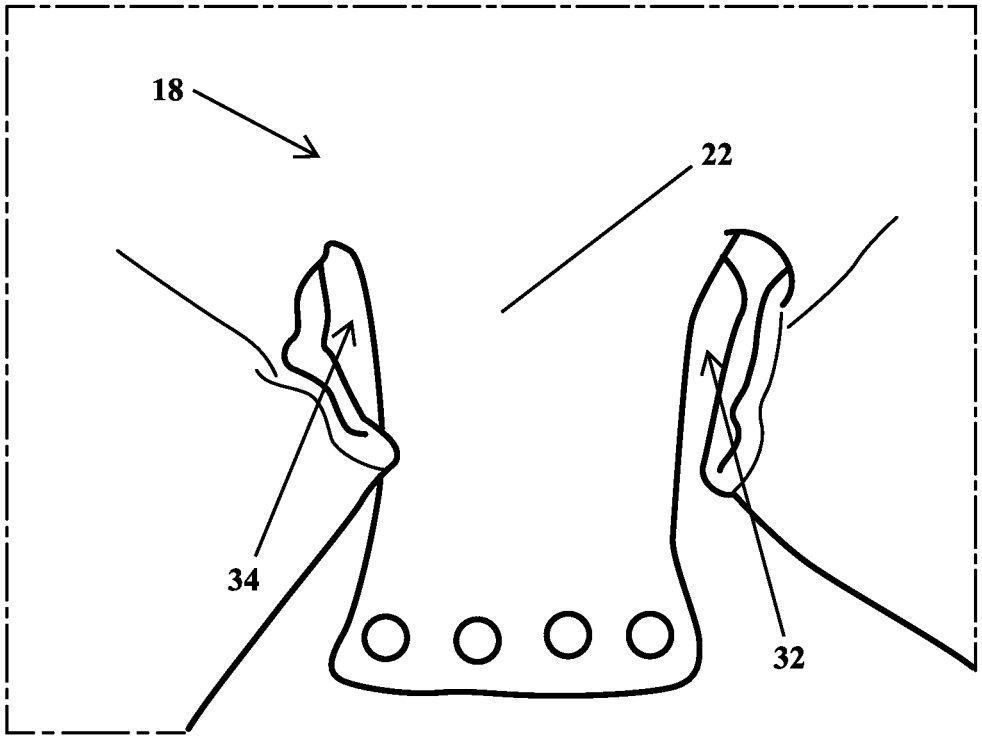
FIG. 6*b* is a back view of the crotch portion of a body shaper in accordance with an embodiment of the disclosure with the crotch portion in the open position.

The body shaper includes a crotch portion 18 that is disposed between the first and second leg portions 14, 16. As illustrated in FIGS. 3 and 6*a*, the crotch portion includes an opening, a first crotch portion extension 20, and a second crotch portion extension 22. The first and second crotch portion extensions 20, 22 are separable to expose the opening, which in turn exposes at least the crotch region of the wearer. In particular, the first and second crotch portion extensions 20, 22 are movable from a first configuration, in which the first and second crotch portion extensions 20, 22 are joined to cover the opening, and consequently the crotch of the wearer (as shown in FIG. 6*a*), to a second configuration in which the first and second crotch portion extensions 20, 22 are separated to expose the opening and consequently at least a portion of the crotch of the wearer (as shown in FIG. 6*b*). In various embodiments, the first and second crotch portion extensions 20, 22 extend from an end of the torso portion 12 in the front and back of the body shaper, which can allow the entire crotch and anal region of the user to be exposed when the first and second crotch portion extensions 20, 22 are in the second (open) configuration.

In accordance with an embodiment of the disclosure, the wearer can urinate or defecate without removal of the body shaper by moving the first and second crotch portion extensions 20, 22 from the first (closed) configuration to the second (open) configurations and retaining the first and second crotch portion extensions 20, 22 in this configuration during urination (or defecation).

The first and second crotch portion extensions 20, 22 can have a sufficiently length to allow the wearer to pull the portions away from their crotch region without their hands remaining in the crotch region. This can enhance the wearer's easy of urinating or defecating while wearing the garment by providing enhanced comfort to the wearer that their hands will remain a sufficient distance away from the crotch region so as not to be accidentally soiled.

The crotch portion extensions have a width $w_c$ sized to cover the crotch region of the wearer. For example, the crotch portion extensions can have a width of about 2 inches to about 6 inches, about 3 inches to about 4 inches, or about 2 inches to about 4 inches. Other suitable widths include, for example, about 2, 2.5, 3, 3.5, 4, 4.5, 5, 5.5, and 6 inches.

Figure 5:
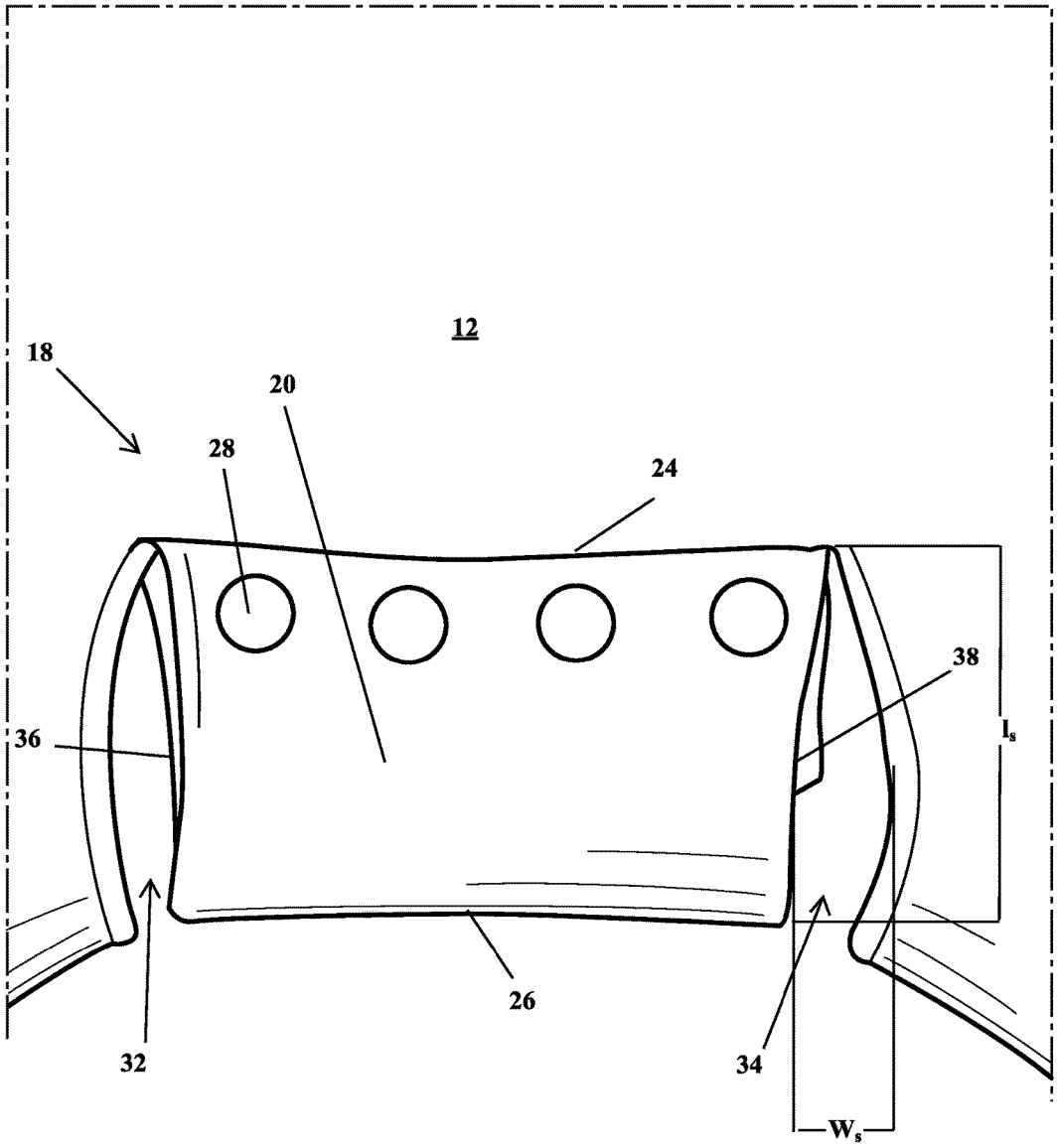
FIG. 5 is a front view of the crotch portion of a body shaper in accordance with an embodiment of the disclosure with the crotch portion in the closed position.

Referring to FIG. 5, when the crotch portion 18 is in the first (closed) configuration, the crotch portion 18 has a first crotch end 24 disposed adjacent to the end of the torso portion 12 and a second crotch end 26 opposite the first end crotch 24.

The first and second crotch portion extensions 20, 22 can have substantially the same or different lengths. In general, the first and second crotch portion extensions 20, 22 can have a length of about ½ inch to about 20 inches, about ¾ inch to about 5 inches, about 1 inch to about 20 inches, about 2 inches to about 18 inches, about 4 inches to about 16 inches, about 6 inches to about 14 inches, about 8 inches to about 12 inches, about 8 inches to about 10 inches, about 2 inches to about 6 inches, or about 1 inches to about 8 inches. Other suitable lengths include, for example, about ½, ¾, 1, 2, 3, 4, 5, 6, 7, 8, 9, 10, 11, 12, 13, 14, 15, 16, 17, 18, 19, and 20 inches. In one embodiment, the first crotch portion extension 20 has a length $l_{cl}$ of about 1¼ inches, and the second crotch portion extension 22 has a length of 5.5 inches.

The lengths of the first and second crotch portion extensions 20, 22 are selected such that when the first and second crotch portion extensions 20, 22 are in the first (closed) configuration the first and second crotch portion extensions 20, 22 can be joined to completely cover the crotch region of the user. Referring to FIG. 3, the first and second crotch portion extensions can overlap in the region of the closure. This can facilitate closure of the crotch portion extensions during use. For example, the first and second crotch portion extensions can overlap about ½ to about 5 inches, about 1 to about 3 inches, about 1 to about 4 inches, or about ¾ to about 3 inches. Other suitable overlap lengths include, for example, about ½, ¾, 1, 1.5, 2, 2.5, 3, 3.5, 4, 4.5, and 5 inches. In one embodiment, the first and second crotch portion extensions overlap about 3½ inches.

The first and second crotch portion extensions can be secured in the first (closed) configuration by one or more closures 28. The location of the one or more closures 28 joining the first and second crotch portion extensions 20, 22 can be selected by selecting the relative lengths of the first and second crotch portions. For example, in an embodiment, the first and second crotch portion extensions 20, 22 have substantially the same length such that in the first (closed) configurations, the first and second crotch portion extensions 20, 22 join at generally the center of the crotch region of the wearer.

Referring to FIG. 6*a*, in some embodiments, the first crotch portion extension 20 can be sized to extend from the torso portion and remain well above the crotch region of the wearer, such that the wearer only need to retain the second crotch portion extension 22 away from the crotch region when the crotch portions are in the second (open) configuration. In such an embodiment, for example, the first crotch portion extension 20 can have a length of about ½ inch to about 3 inches, about ¾ inches to about 2 inches, about 1 inch to about 2 inches, about ½ inch to about 1 inch. Other suitable lengths for such an embodiment include, for example, about ½, ¾, 1, 1.25, 1.5, 1.75, 2, 2.25, 2.5, 2.75, and 3 inches.

Referring to FIGS. 6*a* and 6*b*, in another embodiment, the first crotch portion extension 20 is shorter than the second crotch portion extension 22. For example, the second crotch portion extension 22 can extend from a back side of the body shaper 10 (as shown in FIG. 6*a*) and be adapted to be pulled to the front region of the body shaper 10, covering the crotch region of the wearer, and joining the first crotch portion extension 20 in the front region of the body shaper 10, above the crotch region of the wearer. In such an embodiment, the body shaper 10 can provide improved comfort to the wearer by eliminating seams or closure from being in the crotch region of the user. The embodiment can also provide enhanced usability and ease of usability of the separable crotch portions by making a closure 28 to retain the first and/or second crotch portion extensions 20, 22 in an easily accessible location for the wearer.

Any types of closures 28 can be used for joining the first and second crotch portion extensions 20, 22. For example, hook and eye closures, snaps, buttons, zippers, hook and loop tape, clasps, magnets, such as rare earth magnets, and combinations thereof can be used as the closure.

Any number of closure elements 28 can be included to join the first and second crotch portion extensions 20, 22. For example, the crotch portion can include 1 to 10 closure elements, 2 to 8 closure elements, 3 to 7 closure elements, 4 to 6 closure elements or 1 to 5 closure elements. In one embodiment, the crotch portion 18 includes snaps as the closure element, for example 4 snaps. In another embodiment, the crotch portion 18 can include Velcro as the closure element, with strips of Velcro extending along at least a portion of the width $w_c$ of the crotch portion extensions 20, 22.

Figure 4:
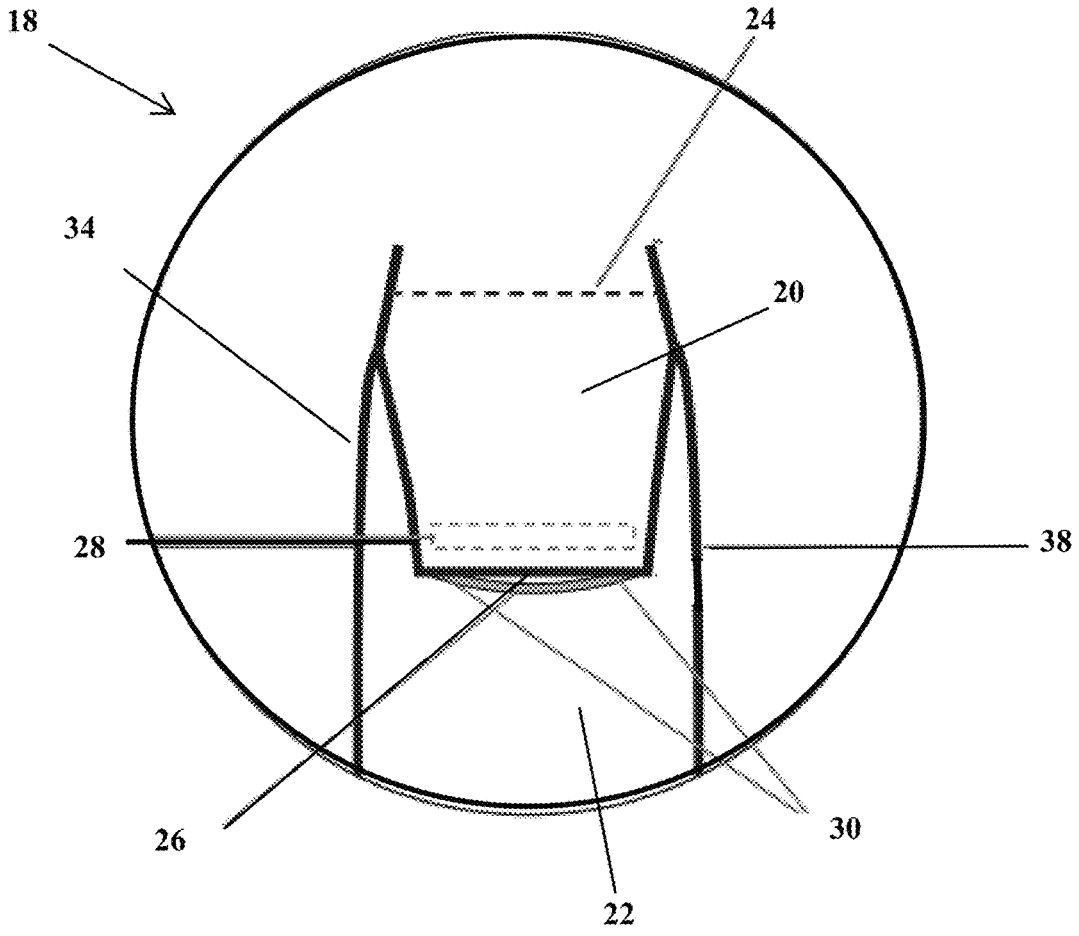
FIG. 4 is a schematic of the crotch portion in the closed position of a body shaper in accordance with another embodiment of the disclosure

Referring to FIG. 4, one or both of the crotch portion extensions 20, 22 can further include a feature to assist in the separation of the crotch portion extensions, gripping, and/or retaining the crotch portion extensions 20, 22 in the open configuration. For example, the one or both of the crotch portion extensions 20, 22 can include a loop or pull tab 30 disposed at the end of the crotch portion extension, which can facilitate grapping the crotch portion extension 20, 22.

Referring to FIG. 5, the body shaper 10 also includes first and second gaps 32, 34 disposed between the first and second leg portions and the crotch portions, respectively. The gaps 32, 34 can generally reside in the region of the wear's hip joint and provide separation between the crotch portion and the first and second leg portions. The gaps 32, 34 advantageously provide improved comfortable and movability when the body shaper 10 is worn by separating the separable crotch portion from the leg portions The length $l_s$ and width $w_s$ of the gaps 32, 34 can be selected such that a separation is provided between the crotch portion and the leg portions, while retaining the gap generally in the region of the hip joint of the wearer, as viewed from the front of the wearer. This can allow the leg portions 14, 16 to maintain sufficient contact and tension encircling the upper hip/thigh of the wearers such that the shaping functionality is maintained in the hip and the buttock of the wearer.

For example, the gaps 32, 34 can have the same of different lengths. For example, the gaps 32, 34 can have a length $l_s$ of about ½ inch to about 6 inches, about 1 inch to about 5 inches, about 2 inches to about 4 inches, about 3 inches to about 4 inches, about 4 inches to about 6 inches, or about 1 inch to about 5 inches. Other suitable lengths include, for example, about ½, ¾, 1, 1.5, 2, 2.5, 3, 3.5, 4, 4.5, 5, 5.5, and 6 inches. The length of the gaps 32, 34 can depend on the body shaper's 10 overall size and the size of the intended wearers. In one embodiment, the gaps 32, 34 have a length of about 3¼ inches.

The gaps 32, 34 can have any suitable width depending on the body shaper's 10 overall size and the size of the intended wearer. For example, body shapers 10 designed for use by a larger-sized wearer may need a gap having a larger width to provide a sufficient separation between the leg portion and the crotch portion to enhance the comfort and maneuverability of the wearer. The width of the gaps 32, 34 can vary along the length of the gaps 32, 34. In one embodiment, the gap generally has a "D" shape, with the width of the gap tapering at the top and bottom ends. For example, the body shaper 10 can have a maximum width $w_s$ of about ¼ inch to about 5 inches, about ¾ inches to about 4 inches, about 1 inch to about 3 inches, about ¼ inch to about 1 inch, about ¾ inch to about 1.5 inches, about ¼ inch to about 2 inches, about 1 inch to about 2 inches. Other suitable widths include, for example, about ¼, ½, ¾, 1, 1.25, 1.5, 1.75, 2, 2.25, 2.5, 2.75, 3, 3.25, 3.5, 3.75, 4, 4.25, 4.5, 4.75, and 5 inches.

The gaps 32, 34 can have a curved shape or a curved portion. For example, as illustrated in FIG. 5, in an embodiment, the gaps 32, 34 can have a "D" shape in which a portion of the gap is curved. In other embodiments, the gaps 32, 34 can have only straight line portions. The gaps 32, 34 can have any suitable shape, for example, a line, a triangular shape, and a diamond shape. The gaps 32, 34 can have, for example, a shape that tapers at the top (near the first crotch end 24) and/or the bottom (near the second crotch end 26).

The gaps 32, 34 can be angled relative to the first and second crotch sides 36, 38 about 65° to about 85°, about 66° to about 84°, about 68° to about 82°, about 70° to about 80°, about 62° to about 70°, about 80° to about 84°, or about 78° to about 82°. Other suitable angles include about 62, 63, 64, 65, 66, 67, 68, 69, 70, 71, 72, 73, 74, 75, 76, 77, 78, 79, 80, 81, and 82°.

The foregoing describes and exemplifies aspects of the invention but is not intended to limit the invention defined by the claims which follow. All of the products and methods disclosed and claimed herein can be made and executed without undue experimentation in light of the present disclosure. While the products and methods of this invention have been described in terms of specific embodiments, it will be apparent to those of skill in the art that variations may be applied to the products and/or methods and in the steps or in the sequence of steps of the methods described herein without departing from the concept, spirit and scope of the invention.

What is claimed:

1. A body shaper, comprising:

a torso portion comprising a rear end portion that extends at or below a lower buttock when worn;

first and second leg portions extending from the torso portion;

a crotch portion disposed at an end of the torso portion between the first and second leg portions, wherein:

the crotch portion comprises an opening, a first crotch portion extension and a second crotch portion extension, the first and second crotch portion extensions being movable between a first configuration, in which the first and second crotch portion extensions are joined to cover the opening and a second configuration in which the first and second crotch portion extensions are separated to expose the opening, and when the first and second crotch portion extensions occupy the first configuration, the crotch portion has a first crotch end attached to the torso portion a second crotch end disposed opposite the first crotch end away from the torso portion, a first crotch side disposed proximate to and spaced from the first leg portion, and a second crotch side disposed opposite the first crotch side and spaced from the second leg portion;

a first gap disposed between the first leg portion and the first crotch side, the first gap having a length extending from the first crotch end to the second crotch end and a width extending from the first crotch side to the first leg portion; and a second gap disposed between the second leg portion and the second crotch side, the second gap having a length extending from the first crotch end to the second crotch end and a width extending from the second crotch side to the second leg portion.

2. The body shaper of claim 1, wherein the first and second gaps have a length extending from the first crotch end to the second end of about 1 inch to about 10 inches.

3. The body shaper of claim 2, wherein the first and second gaps each have a length of about 3.5 inches.

4. The body shaper of claim 1 wherein the first and second gaps have the same lengths.

5. The body shaper of claim 1, wherein the first and second gaps have different lengths.

6. The body shaper of claim 1, wherein at least one edge of the first and second gaps has a curved shaped.

7. The body shaper of claim 1, wherein the first and second gaps have a maximum width of about ¼ inch to about 5 inch.

8. The body shaper of claim 1, wherein the first and second gaps are angled relative to the first and second crotch sides, respectively, about 65° to about 85°.

9. The body shaper of claim 1, wherein the first and second crotch portion extensions are joined with a closure.

10. The body shaper of claim 9, wherein the closure is selected from the group consisting of hook and eye closures, snaps, buttons, zippers, hook and loop tape, clasps, and combinations thereof.

11. The body shaper of claim 10, wherein the closure is disposed on the crotch portion in a front region of the body shaper.

12. The body shaper of claim 1, wherein the first or second crotch portion extension comprises a pull tab for gripping the first or second crotch portion.

13. The body shaper of claim 1, wherein the first crotch portion extension is shorter than the second crotch portion extension.

14. The body shaper of claim 13, wherein:

the first crotch portion extension extends from the torso portion in a front region of the body shaper, and the second crotch portion extension extends from the torso portion in a back region of the body shaper and is adapted to be pulled over the wearer's crotch and adjoin to the first crotch portion extension in the front region of the body shaper.

15. The body shaper of claim 1, wherein the first and second gaps each comprises a substantially straight portion adjacent to the crotch portion and a curved portion adjacent to the respective first and second leg portions.

16. The body shaper of claim 1, wherein when in the second configuration the first and second crotch portion extensions separate to expose both the anus and the urethra of the wearer.

17. The body shaper of claim 1, wherein the first and second leg portions have a length of about 3 inches to about 10 inches.

18. The body shaper of claim 1, wherein the torso portion is sized to extend up to the wearer's chest or extend up to the wearer's hips.

19. The body shaper of claim 1, wherein the first and second leg portions have a length sized to extend to the wearer's mid-thigh or to extend to the wearer's upper-thigh.

20. A method of urinating while wearing the body shaper of claim 1, comprising moving the first and second crotch portion extensions from a first configuration to a second configuration to expose at least a portion of the crotch portion of the wearer.

21. The method of claim 20, further comprising moving the first and second crotch portion extensions from the second configuration to the first configuration in which the first and second crotch portion extensions are joined once the wearer is finished urinating.

22. A method of making a body shaper, comprising:

cutting first and second gaps into a tubular knit, wherein the tubular knit comprises first and second leg portions extending from a torso portion, the torso portion configured to extend at or below a lower buttock when worn, wherein the first and second gaps define a crotch portion separated from the first and second leg portions, respectively, and cutting the crotch portion to define a first crotch portion extension and a second crotch portion extension, the first and second crotch portion extensions being movable from a first configuration in which the first and second crotch portion extensions are joined, and a second configuration in which the first and second crotch portion extensions are separated to expose a crotch of the wearer.

23. The method of claim 22, further comprising stitching a seam on edges of the first and second leg portions adjacent to the first and second gaps and/or edges of the crotch portion adjacent to the first and second gaps.

24. The method of claim 22, wherein the body shaper comprises a single piece of tubular knit fabric having the torso portion, first and second leg portions, and the crotch portions defined therein.

25. The method of claim 22, further comprising applying a lining material to a portion of the crotch portion positioned to contact the wearer's crotch.

26. The body shaper of claim 1, wherein the crotch portion does not extend into or cover the first or second gap in either the first or the second position.

* * * * *